US009926948B1

(12) United States Patent
Wilmot et al.

(10) Patent No.: US 9,926,948 B1
(45) Date of Patent: Mar. 27, 2018

(54) TRANSPORTATION GUARD FOR PYROTECHNIC ACTUATORS

(71) Applicant: TK Holdings Inc., Auburn Hills, MI (US)

(72) Inventors: Larry M. Wilmot, Auburn Hills, MI (US); Rachid Hammoud, Auburn Hills, MI (US); Joshua D. Van Hooser, Auburn Hills, MI (US)

(73) Assignee: TK Holdings Inc., Auburn Hills, MI (US)

( * ) Notice: Subject to any disclaimer, the term of this patent is extended or adjusted under 35 U.S.C. 154(b) by 459 days.

(21) Appl. No.: 14/621,201

(22) Filed: Feb. 12, 2015

Related U.S. Application Data

(60) Provisional application No. 61/939,222, filed on Feb. 12, 2014.

(51) Int. Cl.
*F15B 15/19* (2006.01)
*F15B 15/24* (2006.01)

(52) U.S. Cl.
CPC ..... *F15B 15/19* (2013.01); *F15B 15/24* (2013.01)

(58) Field of Classification Search
CPC ..... F15B 15/19; F15B 15/24; F15B 15/26; F15B 15/267
USPC ..... 60/568, 570
See application file for complete search history.

(56) References Cited

U.S. PATENT DOCUMENTS

2010/0132811 A1* 6/2010 Cappeller ..... F15B 15/1457 137/377

* cited by examiner

*Primary Examiner* — F. Daniel Lopez
*Assistant Examiner* — Daniel Collins
(74) *Attorney, Agent, or Firm* — Meunier Carlin & Curfman LLC

(57) ABSTRACT

A guard attachable to a pressurized fluid-powered actuator incorporating a member extendible from a housing of the actuator. The guard includes a mounting portion structured for affixing the guard to the actuator housing, and a guard member defining an enclosure structured to extend about an end of the actuator housing when the guard member is affixed to the housing.

8 Claims, 7 Drawing Sheets

TRANSPORTATION GUARD FOR PYROTECHNIC ACTUATORS

CROSS-REFERENCE TO RELATED APPLICATIONS

This application claims the benefit of U.S. Provisional Application Ser. No. 61/939,222, filed on Feb. 12, 2014, the disclosure of which is incorporated herein by reference in its entirety.

BACKGROUND OF THE INVENTION

The embodiments described herein generally relate to a pressurized gas-powered actuator and methods and structures usable for storing and/or transporting gas-powered actuators prior to installation in a vehicle or other end-use mechanism.

During product testing, pyrotechnic hood actuators incorporating a piston driven by pressurized fluid may be required to meet a shipping requirement that ensures that the piston rod incorporated into the actuator does not push off of surrounding objects if the actuator is inadvertently activated prior to installation of the actuator in a vehicle (for example, by exposure to an open flame or bonfire event), thereby causing movement of the actuator from its initial location.

Thus, a need exists for an apparatus and method usable for preventing the actuator from "pushing off" of surrounding objects during inadvertent activation.

SUMMARY OF THE INVENTION

In one aspect of the embodiments described herein, a guard is provided which is attachable to a pressurized fluid-powered actuator incorporating a member extendible from a housing of the actuator. The guard includes a mounting portion structured for affixing the guard to the actuator housing, and a guard member defining an enclosure structured to extend about an end of the actuator housing when the guard member is affixed to the housing.

In another aspect of the embodiments of the described herein, an assembly is provided which includes a pressurized fluid-powered actuator including a housing and an extendible member having a portion structured to deploy from the housing upon activation of the actuator, and a guard coupled to the housing. The guard is structured to define a volume adjacent the actuator housing in which the extendible member exterior of the housing is contained, when the extendible member is fully deployed from the housing.

DETAILED DESCRIPTION

Figure 1:
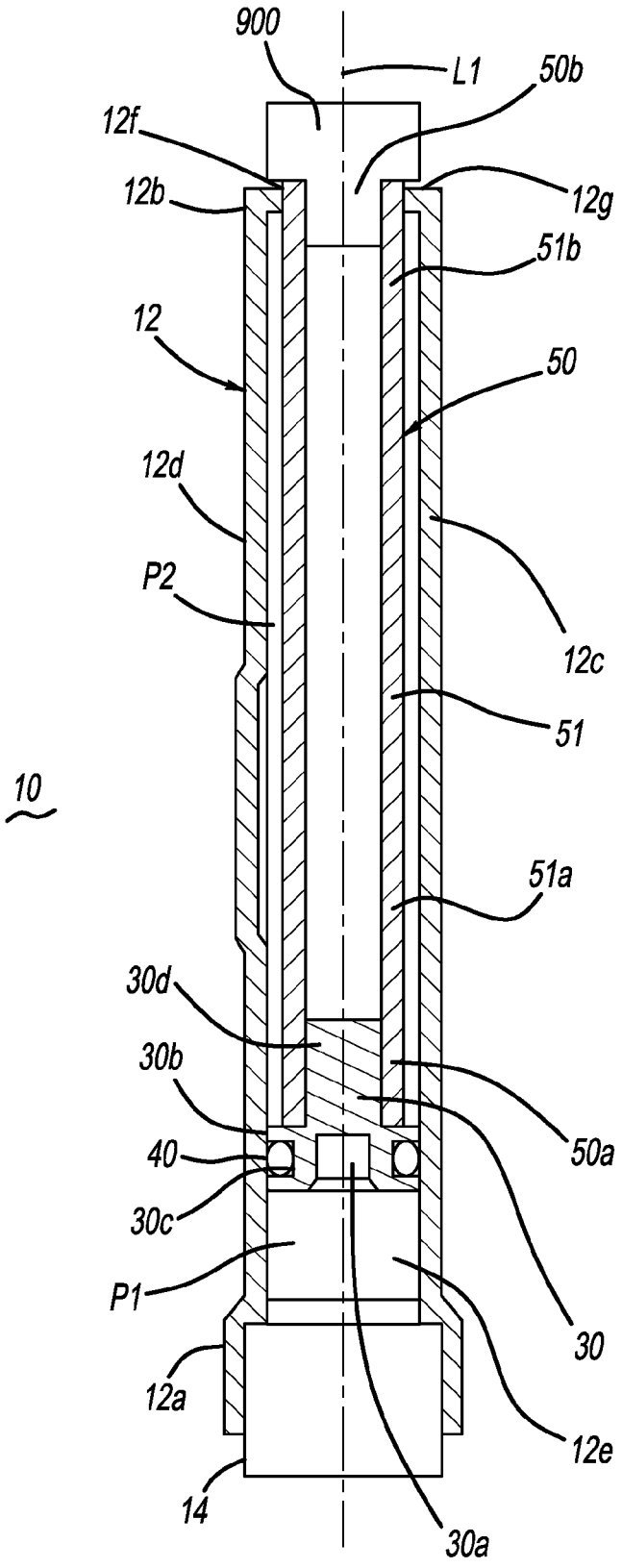
FIG. 1 is a cross-sectional side view of a pressurized gas-powered actuator in a condition prior to activation.

Like reference numerals refer to like parts throughout the description of several views of the drawings. In addition, while target values are recited for the dimensions of the various features described herein, it is understood that these values may vary slightly due to such factors as manufacturing tolerances, and also that such variations are within the contemplated scope of the embodiments described herein.

FIG. 1 shows a cross-sectional side view of a pressurized gas-powered actuator in a condition prior to deployment. The actuator 10 may be mounted to any suitable device or mechanism, and may be operatively coupled (via an extendible member 50, described in greater detail below) to the device or mechanism for transmitting a force to the device or mechanism. The actuation force is generated responsive to the introduction of a pressurized fluid (such as a pressurized gas) into a housing of the actuator, in a manner described below. The pressurized fluid may be generated within the housing (for example, by a gas generator incorporated into the housing), or the fluid may be introduced into the housing from an external fluid source in fluid communication with the housing interior. One possible application for an actuator as described herein is in lifting a portion of a hood of an automotive vehicle.

Figure 2:
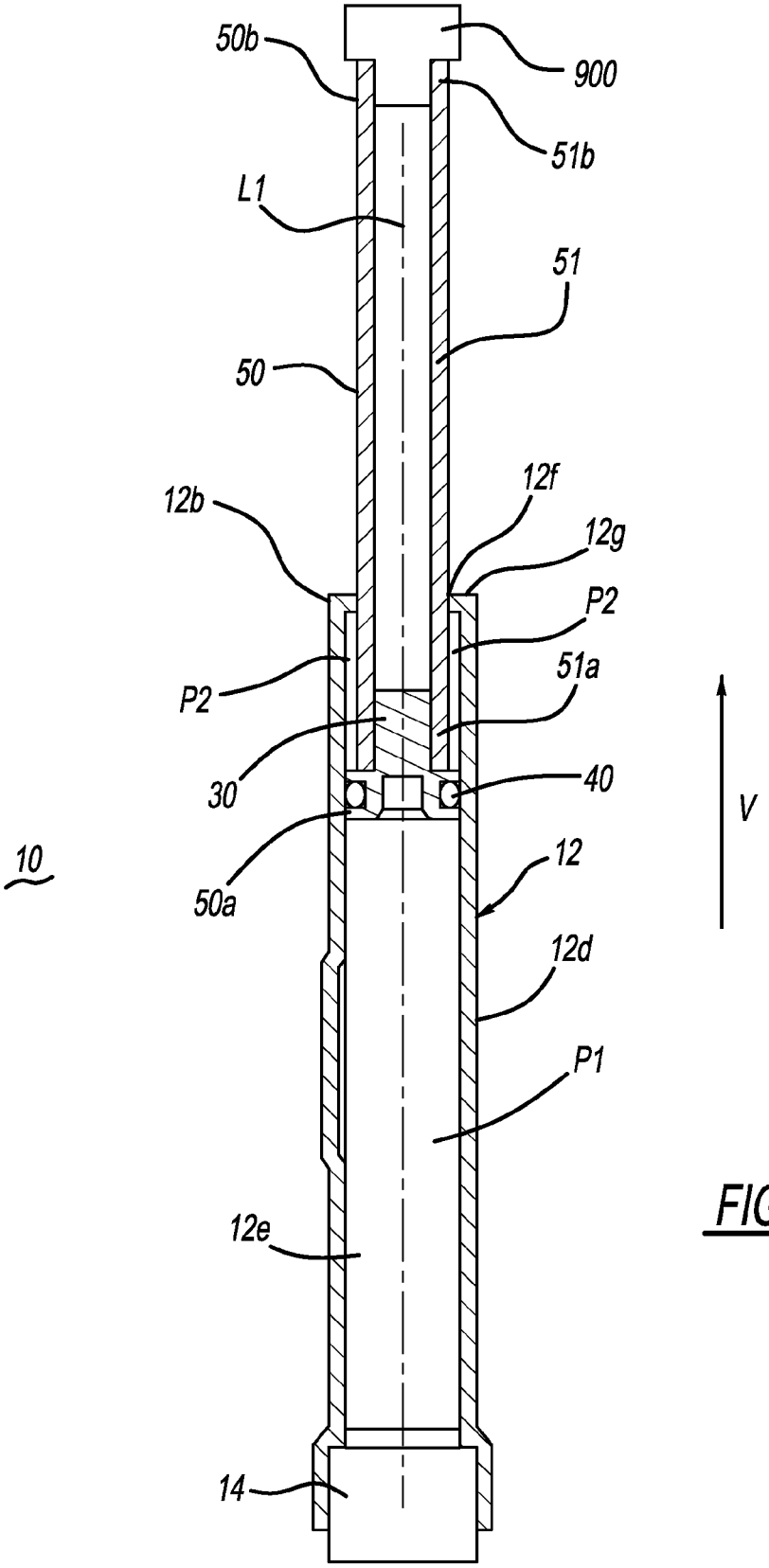
FIG. 2 is a cross-sectional side view of the pressurized gas-powered actuator of FIG. 1 after deployment of a extendible member from the actuator housing in a direction V.

FIG. 2 shows a cross-sectional side view of the pressurized fluid-powered actuator of FIG. 1 after activation of the actuator and deployment of the extendible member 50 from the housing 12 in a direction V. In the embodiment shown in FIGS. 1 and 2, actuator 10 has a housing 12, a piston 30 slidably positioned within the housing, and an extendible member 50 attached to the piston 30 so as to move in conjunction with the piston. Housing 12 has an outermost housing wall 12*d* defining a first end 12*a*, a second end 12*b*, a longitudinal central axis L1 of the housing 12, and a body 12*c* connecting the first and second ends. Wall 12*d* also defines a hollow interior 12*e* of the housing. In the embodiment shown in FIGS. 1-2, housing first end 12*a* is flared radially outwardly to accommodate a suitable gas generator 14 (for example, a known micro-gas generator) or other pressurized fluid source (or a connection to a fluid source), which may be inserted and retained therein by crimping, adhesive attachment, or any other suitable method. Alternatively, the gas generator or fluid source 14 may be attached to housing first end using a suitable retention method. A fluid-emitting portion of the fluid source 14 is positioned within the housing so that pressurized fluid flows into the housing interior after activation of the fluid source to generate or release the pressurized fluid. If desired, a suitable seal (such as an epoxy seal, o-ring seal or other sealing means; not shown) may be provided to prevent or minimize leakage of generated gas or other pressurized fluid between the fluid source 14 and the housing 12 to an exterior of the housing. Thus, in certain embodiments, the pressurized fluid source may be incorporated into the actuator (for example, in an embodiment including a micro-gas generator secured to the housing 12), while in other embodiments the pressurized fluid source may be operatively coupled to (but separate from) the fluid source.

In the embodiment shown in FIGS. 1-2, housing second end 12*b* has an opening 12*f* structured to receive therethrough at least a portion of an extendible member 50 attached to piston 30, which is slidably positioned in the housing interior. Opening 12*f* may be sized or otherwise structured to laterally constrain or support the extendible member 50 as portions of the member move into and out of the housing through opening 12*f*. In the particular embodiment shown in FIGS. 1-2, an end wall 12*g* is formed from a portion of housing 12, and opening 12*f* is drilled or otherwise formed in the wall 12*g*. If desired, a reinforcing cap (not shown) may be secured to end 12*b* of the housing by welding or any other suitable means, to strengthen the housing end against impact forces exerted by the piston 30 contacting the end wall 12*g* at the end of the piston stroke.

Piston 30 is slidably positioned within housing interior 12*e*. Piston 30 has a base 30*a* with an outer wall 30*b*. A groove 30*c* is formed in outer wall 30*b* and is structured for receiving therein an O-ring 40 or another suitable resilient gas-tight seal. In a known manner, O-ring 40 resiliently engages or contacts the interior surfaces of housing wall 12*d*, thereby providing a substantially gas-tight seal between the piston 30 and wall 12*d*. When piston 30 is positioned in housing 12 with O-ring 40 contacting the housing wall interior surfaces, the region of contact between the O-ring and the housing wall defines a boundary between a higher pressure side P1 of the piston and a lower pressure side P2 of the piston.

In the embodiment shown in FIGS. 1-2, a projection 30*d* extends from piston base 30*a*. Projection 30*d* is structured for engaging (or for suitable attachment to) an associated extendible member 50 in an interference fit, or for otherwise enabling or facilitating attachment of the extendible member 50 to the piston 30.

Extendible member 50 is the mechanism through which the actuator force is transmitted to an element (for example, a portion the underside of a hood of a vehicle (not shown) proximate or connected to the extendible member. Extendible member-50 has a first end 50*a* attached to the piston so as to move in conjunction with the piston. A second end 50*b* of the extendible member opposite the first end 50*a* may be configured for attachment to an element or mechanism to which the actuator force is to be transmitted. In the embodiment shown in FIGS. 1-2, extendible member 50 includes a hollow piston rod 51 having a first end 51*a* and a second end 51*b* opposite the first end. Alternatively, the piston rod 51 may be solid. The piston rod 51 may also have any particular length, diameter, shape and/or other characteristic(s) suitable or necessary for a particular application.

Also, in the embodiment shown in FIGS. 1-2, extendible member 50 includes a cap or other attachment (generally designated 900 in FIGS. 1-2) affixed to piston rod second end 51*b*. Attachment 900 is structured to be attached to (or to otherwise suitably engage) a mechanism to which the actuator force is to be imparted (for example, an underside of the vehicle hood). Thus, in this embodiment, the actuator force is transmitted from the piston rod 51 to the actuated mechanism via the attachment 900.

In an alternative embodiment, the extendible member 50 is formed by the piston rod alone (i.e., without an attachment secured to an end of the piston rod).

FIGS. 3A-6B show various embodiments of an actuator guard attachable to a portion of the actuator 10 at a location designed to enclose or encapsulate the actuator extendible member 50 when the member is in a deployed condition. In embodiments described herein, the guard generally includes a mounting portion structured for affixing the guard to the actuator housing or to some other suitable portion of the actuator, and a guard member defining an enclosure structured to extend about an end of the actuator housing when the guard member is affixed to the housing.

FIGS. 3A-3C and 4 show one embodiment 501 of an actuator guard attachable to a portion of the actuator 10 at a location designed to enclose or encapsulate the actuator extendible member 50 when the member is in a deployed condition. In the embodiment shown in FIGS. 3A-3C and 4, actuator 10 includes a wiring harness of other suitable signal transmission means 197 operatively coupled to fluid source 14 (in the embodiment shown, a known or suitable gas generator). The guard 501 encloses or encapsulates any portion of the extendible member residing exterior of the housing prior to actuator deployment, and also encloses or encapsulates the movement path of any portion of the extendible member 50 during deployment or extension of the extendible member from the housing. The guard 501 also encloses or encapsulates all portions of the extendible member extending from the housing when the extendible member is fully extended or deployed from the housing 12. Thus, the guard effectively defines a volume adjacent the actuator housing in which the portion of the extendible member projecting from the housing is completely contained, when the extendible member is fully deployed or extended from the housing. This prevents the extendible member 50 from contacting and pushing (or pushing off of) objects positioned exterior of the guard 501 and/or actuator 10 if the actuator is activated prior to its installation in a vehicle (for example, by exposure to an open flame or bonfire event). Such movement of the extendible member 50 may cause movement of the actuator from its initial location.

Figure 3A:
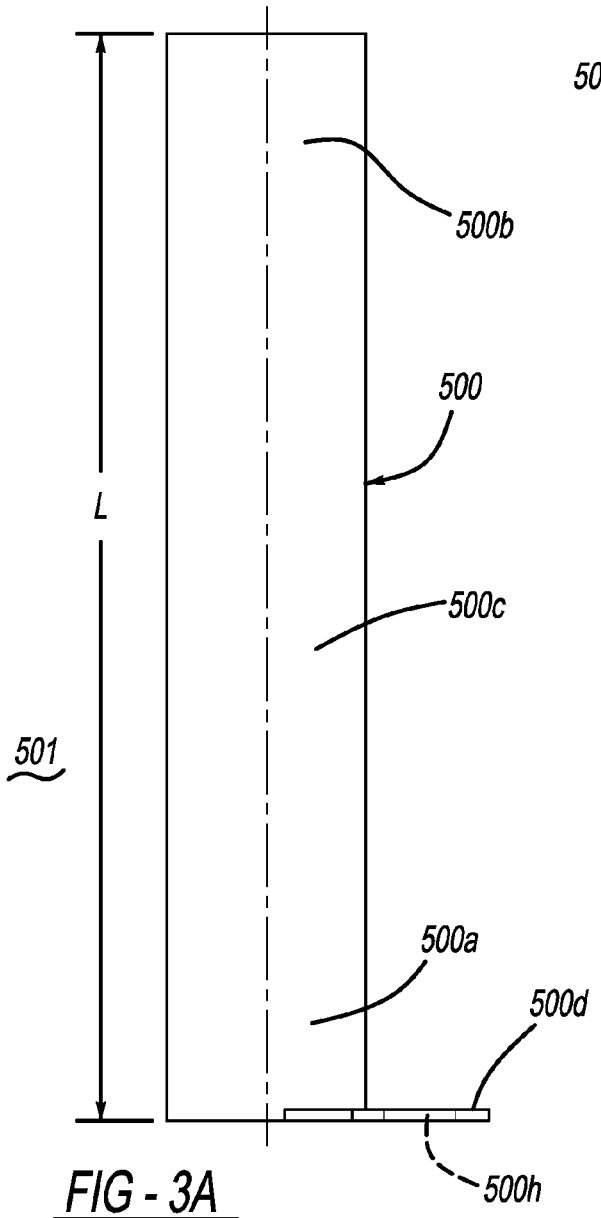
FIG. 3A is a side exterior view of an actuator guard in accordance with an embodiment described herein.
Figure 3B:
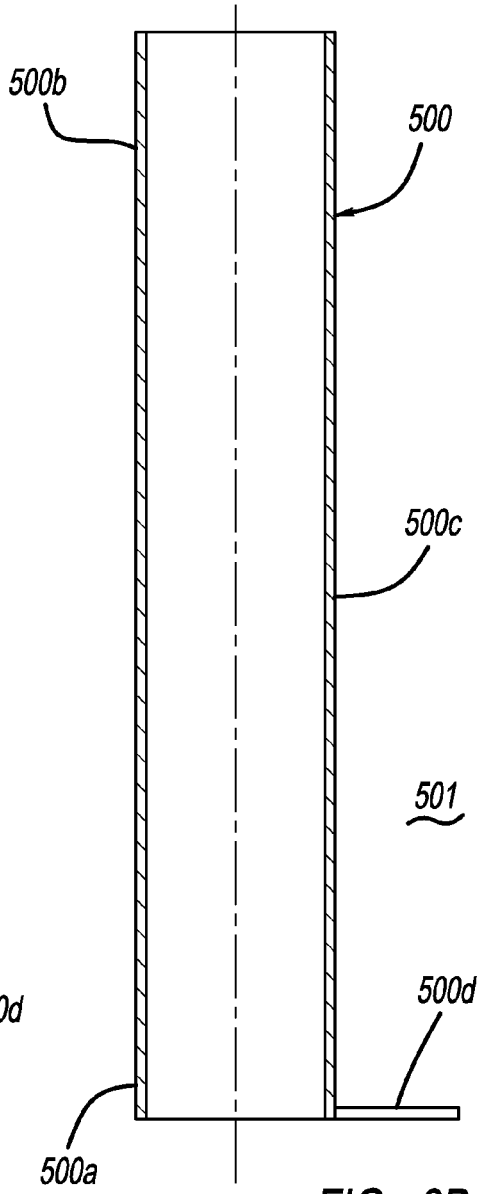
FIG. 3B is a cross-sectional side view of the guard embodiment shown in FIG. 3A.
Figure 3C:
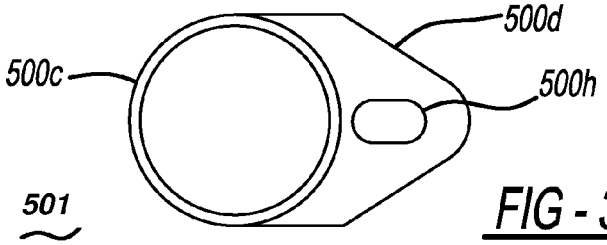
FIG. 3C is a plan view of the guard embodiment shown in FIG. 3A.
Figure 4:
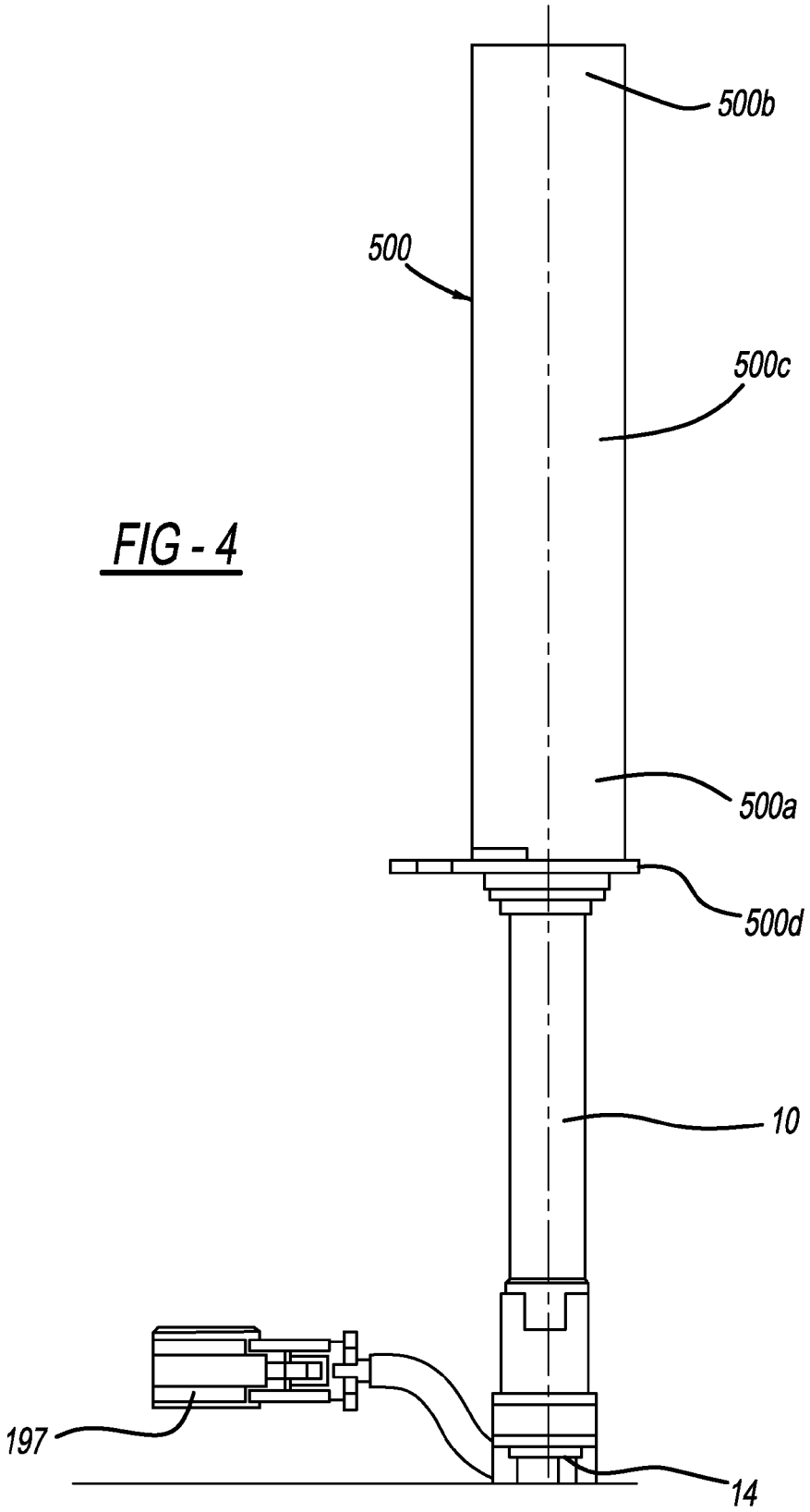
FIG. 4 is a side view of the actuator guard of FIGS. 3A-3C attached to an actuator.
Figure 5A:
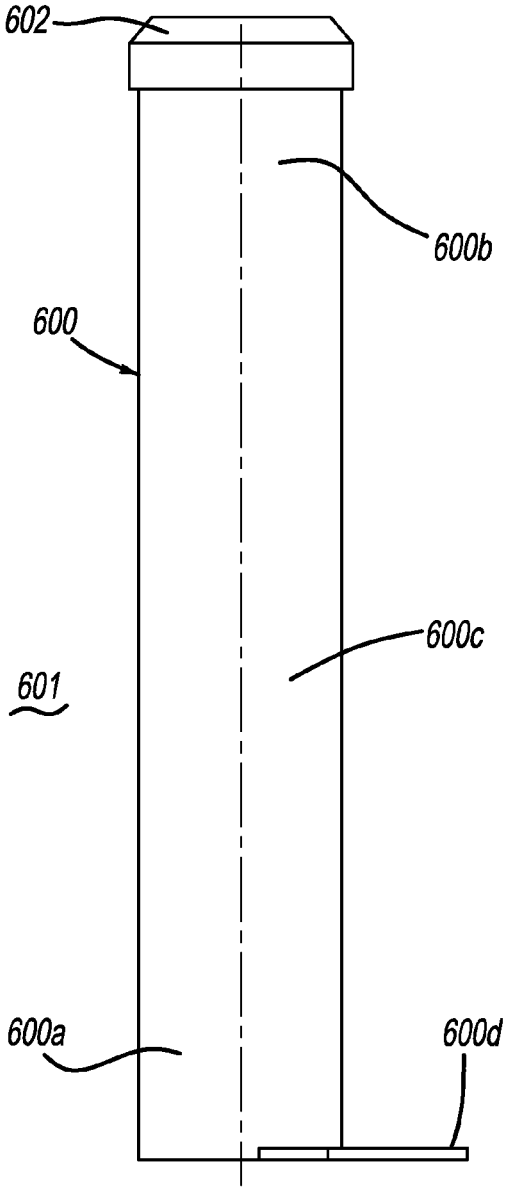
FIG. 5A is a side exterior view of an actuator guard in accordance with another embodiment described herein.
Figure 5B:
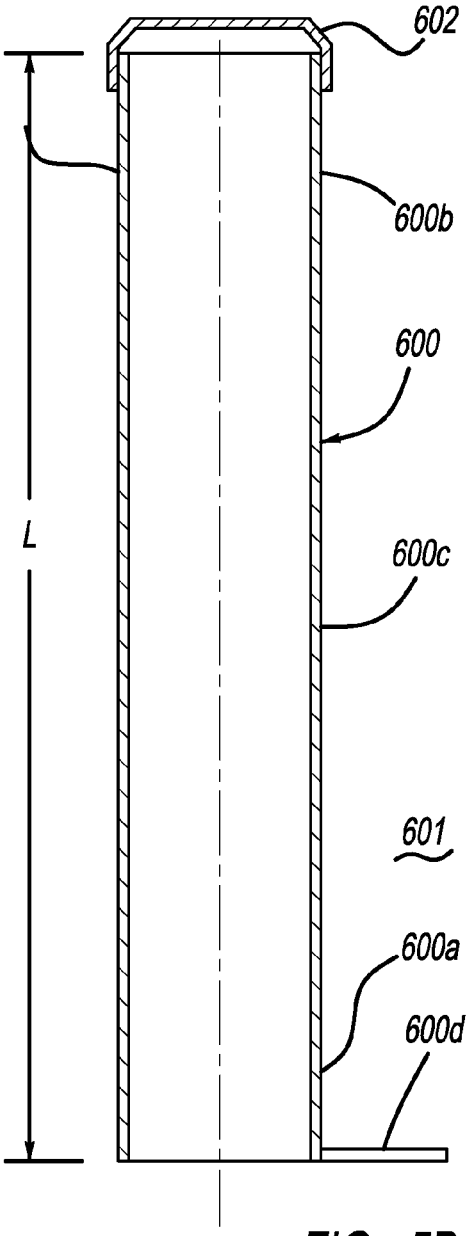
FIG. 5B is a cross-sectional side view of the guard embodiment shown in FIG. 5A.
Figure 5C:
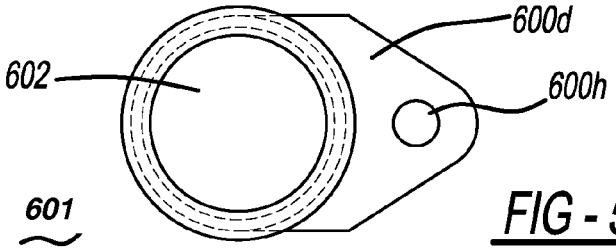
FIG. 5C is a plan view of the guard embodiment shown in FIG. 5A.

Referring to FIGS. 3A-3C and 4, in one embodiment, guard 501 includes a guard member 500 which is generally cylindrical in shape and has a first end 500*a*, a second end 500*b* opposite the first end, and a hollow body 500*c* extending between and connecting the ends 500*a* and 500*b*, and defining an interior of the guard. In the embodiment shown in FIGS. 3A-3C, second end 500*b* is open. The guard member embodiment shown in FIGS. 3A-3C is generally cylindrical. However, the guard member may have any shape desirable for a particular application.

A mounting flange 500*d* may be attached to first end 500*a* and is structured for attachment to a portion of actuator 10, using any of a variety of suitable methods (for example, a threaded connection, an adhesive connection, etc.) designed to keep the guard mounted in position on the actuator 10 during storage, transportation, and also during any inadvertent activation of the actuator, until the guard is manually or otherwise intentionally removed from the actuator. A mounting hole 500*h* may be formed in flange 500*d*, to facilitate orienting the assembly for packaging and/or transportation. The guard may be removed from the actuator prior to installation of the actuator into a vehicle.

Figure 6A:
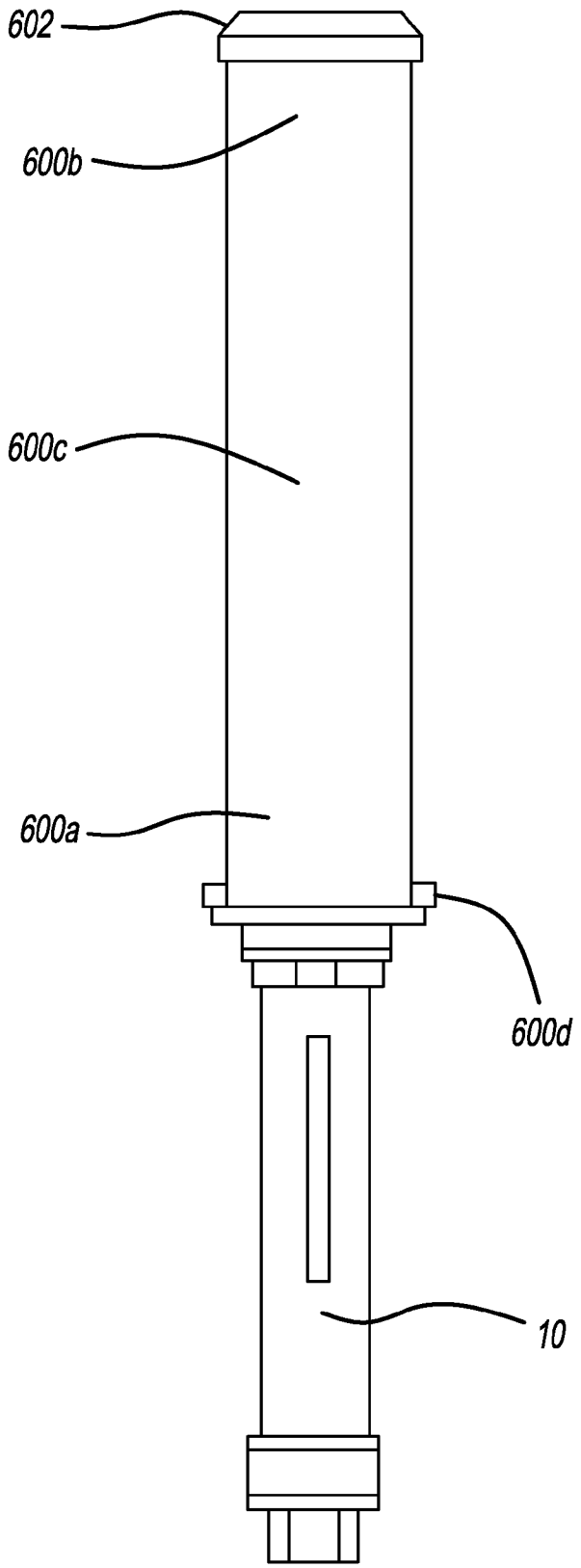
FIG. 6A is a side view of an assembly including the actuator guard of FIGS. 5A-5C attached to an actuator.
Figure 6B:
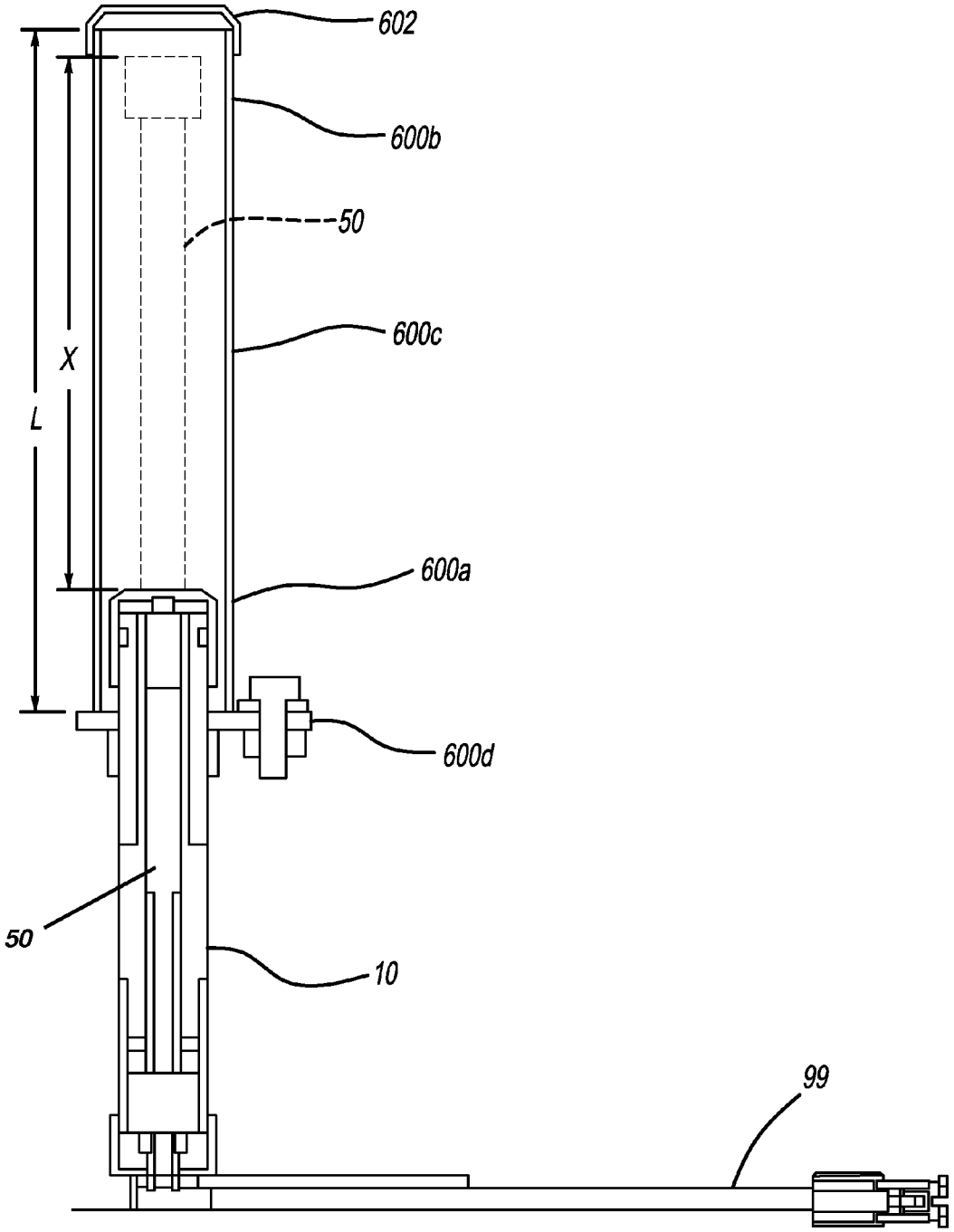
FIG. 6B is a schematic cross-sectional side view of the assembly shown in FIG. 6A, and showing the position of an embodiment of the extendible member prior to actuator activation, and also showing the extendible member in a fully deployed position after actuator activation.

Generally, the length L of the guard is specified (in relation to the attachment point of the guard to the actuator, the stroke length of the extendible member 50, and other pertinent parameters) so as to extend to a distance from the housing end 12*b* which exceeds the farthest distance X (as indicated by the dashed outline of extendible member 50 shown in FIG. 6B) to which the extendible member 50 extends from the housing end 12*b* at full deployment. This ensures that the guard encloses the extendible member during and after deployment of the extendible member.

FIGS. 5A-6B show another embodiment 601 of an actuator guard attachable to a portion of the actuator 10 at a location designed to enclose or encapsulate the actuator extendible member 50 when the member is in a deployed condition. This embodiment is similar to the embodiment shown in FIGS. 3A-4, except that guard 601 includes a cap 602 to close and/or seal the open end 600*b* of the guard member 600. Cap 602 functions to prevent foreign objects from entering guard member end 600*b*. Cap 602 may also be structured to help retain extendible member 50 within the volume defined by the guard housing in the event of inadvertent actuator activation.

In a particular embodiment, as shown in FIG. 6B, the guard member 600 and cap 602 (when attached to the guard member 600) act to completely enclose the extendible member 50 when the member is fully deployed (i.e., there are no openings in either the guard member, the cap, or the attachment of the guard member to the actuator by which foreign objects can enter the interior volume of the guard).

Components of the guard described herein may be formed from metallic materials, polymeric materials, and/or any other suitable material or materials.

It is seen that the embodiments of the guard described herein also impede or prevent foreign objects from coming into contact with the extendible member 50 and cap 900 prior to extendible member deployment.

In the embodiments shown in the Figures, guards 500 and 600 are hollow cylindrical structures. However, the guard may have any desired shape or configuration needed for the purpose of enclosing the extendible member flow path as described herein.

It will be understood that the foregoing descriptions of the various embodiments are for illustrative purposes only. As such, the various structural and operational features herein disclosed are susceptible to a number of modifications, none of which departs from the scope of the appended claims.

What is claimed is:

1. A guard attachable to a pressurized fluid-powered actuator incorporating an extendible member that is extendible from an end of a housing of the actuator, the guard comprising a mounting portion for affixing the guard to the housing and a guard member coupled to the mounting portion, the guard member defining an enclosure for extending from the end of the housing when the guard member is affixed to the housing, wherein a volume defined by the enclosure is static.

2. The guard of claim 1 further comprising a cap attachable to an open end of the guard member so as to close the open end.

3. The guard of claim 1 wherein the guard member is generally cylindrical in shape.

4. The guard of claim 1 wherein the mounting portion comprises a mounting flange attached to the guard member and structured for attachment to the housing of the actuator.

5. An assembly including a guard in accordance with claim 1.

6. An assembly comprising:

a pressurized fluid-powered actuator including a housing and an extendible member having a portion structured to deploy from the housing upon activation of the actuator; and a guard coupled to the housing, wherein the guard is structured to define a volume adjacent the housing in which any portion of the extendible member exterior of the housing is contained when the extendible member is fully deployed from the housing, wherein the volume is static.

7. The assembly of claim 6 wherein the guard includes a guard member and a cap affixed to an end thereof so as to close the end.

8. The assembly of claim 7 wherein the guard member and cap combine to completely enclose the extendible member when the member is fully deployed from the housing.

* * * * *